US011842630B2

(12) United States Patent
Tonguz et al.

(10) Patent No.: US 11,842,630 B2
(45) Date of Patent: Dec. 12, 2023

(54) SYSTEM AND METHOD IMPLEMENTING VIRTUAL PEDESTRIAN TRAFFIC LIGHTS

(71) Applicant: CARNEGIE MELLON UNIVERSITY, Pittsburgh, PA (US)

(72) Inventors: Ozan Tonguz, Pittsburgh, PA (US); Rusheng Zhang, Pittsburgh, PA (US); Lin Song, Pittsburgh, PA (US); Adhishree Jaiprakash, Pittsburgh, PA (US)

(73) Assignee: Carnegie Mellon University, Pittsburch, PA (US)

( * ) Notice: Subject to any disclaimer, the term of this patent is extended or adjusted under 35 U.S.C. 154(b) by 4 days.

(21) Appl. No.: 17/752,952

(22) Filed: May 25, 2022

(65) Prior Publication Data

US 2022/0284805 A1 Sep. 8, 2022

Related U.S. Application Data

(63) Continuation of application No. 17/190,983, filed on Mar. 3, 2021, now abandoned.

(60) Provisional application No. 62/984,324, filed on Mar. 3, 2020.

(51) Int. Cl.
*G08G 1/005* (2006.01)
*G08G 1/09* (2006.01)

(52) U.S. Cl.
CPC ..... *G08G 1/005* (2013.01)

(58) Field of Classification Search
None
See application file for complete search history.

(56) References Cited

U.S. PATENT DOCUMENTS

| | | | | |
|---|---|---|---|---|
| 9,829,889 | B1 * | 11/2017 | Kusano | G08G 1/096741 |
| 2014/0278029 | A1 * | 9/2014 | Tonguz | G08G 1/161 701/117 |
| 2015/0228195 | A1 * | 8/2015 | Beaurepaire | B60Q 1/5035 340/907 |
| 2017/0227964 | A1 * | 8/2017 | Lehtiniemi | G05D 1/0088 |
| 2018/0174449 | A1 * | 6/2018 | Nguyen | G08G 1/0104 |
| 2021/0136543 | A1 * | 5/2021 | Hannestad | H04W 4/023 |

OTHER PUBLICATIONS

Ferreira et al., "Self-Organized Traffic Control" VANET '10: Proceedings of the seventh ACM international workshop on Vehicular Internetworking—Sep. 2010—pp. 85-90.

Tonguz, O.K. & Viriyasitavat, Wantanee. (2016). A self-organizing network approach to priority management at intersections. IEEE Communications Magazine. 54. 119-127.

* cited by examiner

*Primary Examiner* — John F Mortell
(74) *Attorney, Agent, or Firm* — KDW Firm PLLC

(57) ABSTRACT

Disclosed herein is a virtual pedestrian traffic light (VPTL) system and method that provides an infrastructure-free way to provide the right-of-way to pedestrians at intersections. The invention is most effective when integrated with existing virtual traffic light (VTL) systems to provide complete infrastructure-free control of traffic at intersections.

20 Claims, 6 Drawing Sheets

SYSTEM AND METHOD IMPLEMENTING VIRTUAL PEDESTRIAN TRAFFIC LIGHTS

RELATED APPLICATIONS

This application is a continuation of and claims the benefit of priority to U.S. patent application Ser. No. 17/190,983, titled "SYSTEM AND METHOD IMPLEMENTING VIRTUAL PEDESTRIAN TRAFFIC LIGHTS," filed Mar. 3, 2021, which claims the benefit of U.S. Provisional Patent Application No. 62/984,324, filed Mar. 3, 2020, the contents of which are incorporated herein their entirety.

BACKGROUND

Currently, pedestrian traffic at some intersections is handled by pedestrian traffic light infrastructure. When there is a need to cross the street, a pedestrian can push a button physically located at the intersection, and the pedestrian traffic light gives provides a timed pedestrian phase during the traffic cycle (i.e. the right-of-way is yielded to the pedestrian for a fixed period of time).

This approach has significant drawbacks. First, the required infrastructure is costly and, as such, it is not feasible to equip a majority of intersections with the required infrastructure. Second, the fixed-time pedestrian phase is inefficient. When a pedestrian crosses the intersection in a period of time much less than the timed pedestrian phase, this leaves vehicles waiting at the intersection until the timed pedestrian phase ends. Third, and more importantly, a timed pedestrian phase is not friendly to pedestrians requiring more time to cross the intersection than is provided by the timed pedestrian phase, for example, the elderly, the sick, the disabled, pregnant women, etc. As such, the timed pedestrian phase may expire before the slower crossers are able to reach the opposite side of the intersection, leading to potential safety issues.

A system of Virtual Traffic Lights (VTL) is a self-organizing traffic control scheme based on vehicle-to-vehicle (V2V) communication. VTL technology eliminates the need for infrastructure-based traffic lights, and, as such, it has the potential to significantly lower the infrastructure costs at intersections. One embodiment of a VTL system is described in PCT application PCT/US2018/043090, published as WIPO publication WO 2019/018766. This application described an embodiment in which vehicles are able to communicate with existing infrastructure at intersections. Another implementation is described in PCT application PCT/US2018/054604, published as WIPO publication WO 2019/081122, which describes a system that implements VTL using mobile computing devices in vehicles. Still another embodiment is described in PCT application PCT/US2018/054504, published as WIPO publication WO 2019/017065, which describes a VTL implementation for non-ideal situations in which no line-of-sight exists between intersecting road, such as in "urban canyons".

Given the disadvantages of the current, infrastructure-based pedestrian traffic light systems, it would be desirable to be able to provide a virtual pedestrian traffic light (VPTL) system as a standalone system at intersections or as a modification of existing VTL systems.

SUMMARY

Disclosed herein is a virtual pedestrian traffic light (VPTL) system and method that can be used as a standalone, infrastructure-free pedestrian traffic coordination system or which can be integrated into existing VTL systems, including, but not limited to, those mentioned in the Background section above. The VPTL system and method disclosed herein is designed to provide a pedestrian phase during the traffic cycle at intersections and it enables existing VTL systems to handle pedestrians in an adaptive manner.

In a primary aspect, the present invention provides a distributed, adaptive, infrastructure-free VPTL system that provides a pedestrian phase during a traffic cycle on demand.

In another aspect, the invention provides a VPTL system with an adaptive pedestrian traffic phase, the length of which is based on real-time tracking of pedestrians as they cross the intersection. This aspect of the invention will save time for vehicles when fast-crossing pedestrians are in the intersection and will provide for the safety of slower-crossing pedestrians who may require a longer time to cross the intersection.

In another aspect, the invention provides a VPTL system that is based on personal mobile computing devices, for example, smart phones, smart watches and tablet computing devices, or other wearable smart devices now known or later developed, such that the system is infrastructure-free and easily implementable.

In another aspect, the invention provides a VPTL system can be stand-alone or can be integrated into other distributed traffic management systems, including both conventional and VTL systems.

In another aspect, the invention provides a VPTL system that is implemented using software executing on a personal mobile computing device (e.g., an iOS® app, an Android® app or other apps on wearable other device platforms), which provides a user interface to the pedestrian when there is a need to cross an intersection.

The disclosed invention provides a system and method that implements all or a subset of the above-mentioned aspects to provide an infrastructure-free VPTL system.

BRIEF DESCRIPTION OF THE DRAWINGS

FIG. 1(*b*) is an illustration of the method of the present invention which provides an infrastructure-free method of allowing the pedestrian to request the right-of-way to cross the intersection and to provide an indication via a virtual pedestrian traffic light as to when the pedestrian has been granted the right-of-way and may therefore proceed to safely cross the intersection.

DEFINITIONS

As used herein, the terms "green" and "red" do not necessarily refer to colors, but instead are used to indicate that a right-of-way has been granted, indicated by a "green" right-of-way indicator, or that a right-of-way has been yielded, indicated by "red" right-of-way indicator. The actual display of the right-of-way indicator may be by any known means, for example, by text, symbols, colors, sounds, vibrations, etc.

As used herein, the terms "pedestrian" and "mobile computing device" are used interchangeably, as it is assumed that the pedestrian is carrying the mobile computing device.

DETAILED DESCRIPTION

To implement the aspects of the invention mentioned in the Summary, an infrastructure-free solution for implementation of a VPTL system is disclosed that is based on pedestrian tracking technology and wireless communications. In the disclosed system, instead of pushing a physical button, the pedestrian makes a user selection of a button on the user interface of a VPTL application running on a personal mobile computing device, for example, a smartphone, a smart watch, a tablet, etc. The VPTL application then communicates with vehicles approaching the intersection, via a wireless communication. A lead vehicle amongst the approaching vehicles is selected and the lead vehicle controls the status of the traffic lights and the pedestrian indicator at the intersection. The display of the VPTL application will display the current phase of the traffic cycle to the pedestrian and the right-of-way will be yielded to the pedestrian on demand. When the pedestrian is given the right-of-way, a pedestrian tracking system will be activated and the location of the pedestrian will be tracked until the pedestrian reaches the opposite side of the intersection, at which time the right-of-way is yielded to the vehicles on one road at the intersection.

Figure 1A:
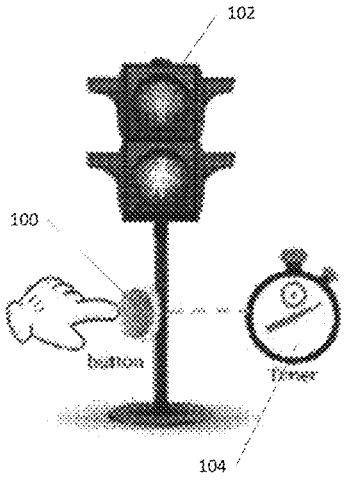
FIG. 1(*a*) is an illustration of a prior art system and method for providing a pedestrian phase during a traffic cycle wherein a pedestrian at an intersection is able to request the right-of-way to cross the intersection using install physical infrastructure.
Figure 1B:
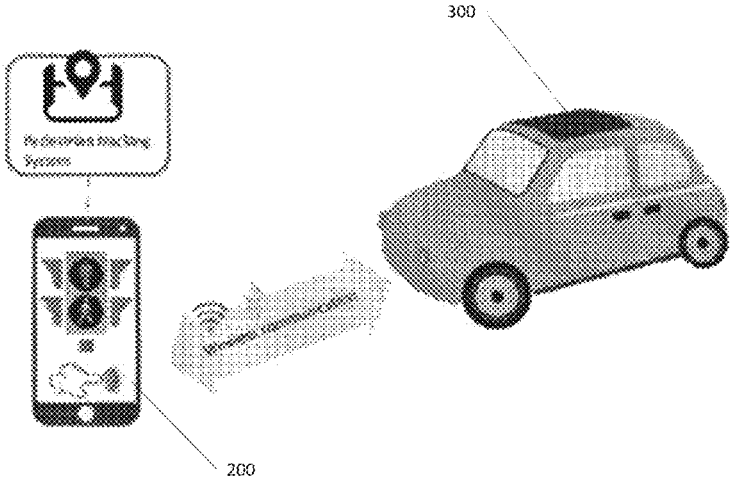

FIG. 1 shows the comparison between the current scheme and the solution provided by the present invention. In current pedestrian traffic light systems, shown in FIG. 1(*a*), the pedestrian pushes a button 100 on a physical infrastructure 102 (typically a dedicated mast or pole with a pedestrian right-of-way request button) to request a pedestrian phase of the traffic cycle. When the pedestrian phase begins, a timer 104 is started, giving the pedestrian a fixed-time pedestrian phase during which the pedestrian may safely cross the intersection. In the present invention, shown in FIG. 1(*b*), the button and virtual pedestrian traffic light are provided by the VPTL application 200, and the VPTL application 200 communicates with vehicles 300 via a wireless communication channel to provide a pedestrian phase.

Figure 2:
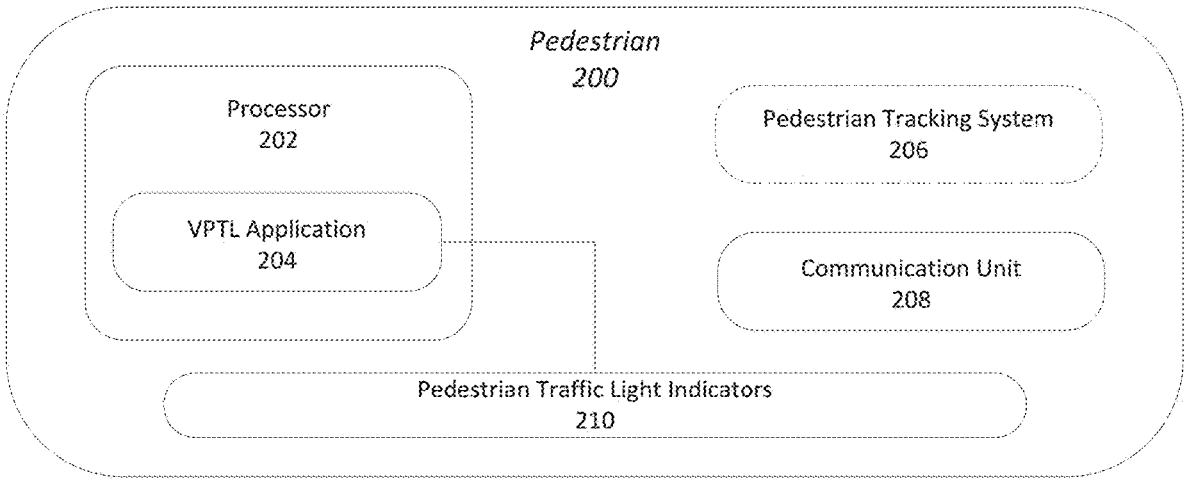
FIG. 2 is a block diagram of components of a VPTL system implemented on the pedestrian end.

FIG. 2 is a block diagram showing one possible embodiment of the components of the system on the pedestrian device 200 which are required to implement various embodiment of the VPTL system. Pedestrian device 200 includes processor 202 running the VPTL application 204, which includes a display of a virtual pedestrian traffic light indicator 210. In addition, pedestrian device 200 will include a communication unit 208, which may be any wireless form of communication, for example, Wi-Fi, Bluetooth or any other well-known or later-developed wireless communication system capable of short- to medium-range peer-to-peer wireless communication. Lastly, pedestrian device 200 may optionally include a pedestrian tracking system 206, which will be discussed later herein. The processor 202 and communication unit 208 may be a native part of pedestrian device 200 which, as previously mentioned, could be any currently known or later developed mobile computing device, such as a smartphone, smartwatch, tablet or other devices, including, for example, wearable devices such as augmented reality devices. VPTL application 204 may come in the form of a downloadable and/or installable application, for example, an application running under the Apple® iOS operating system or the Android® operating system.

Figure 3:
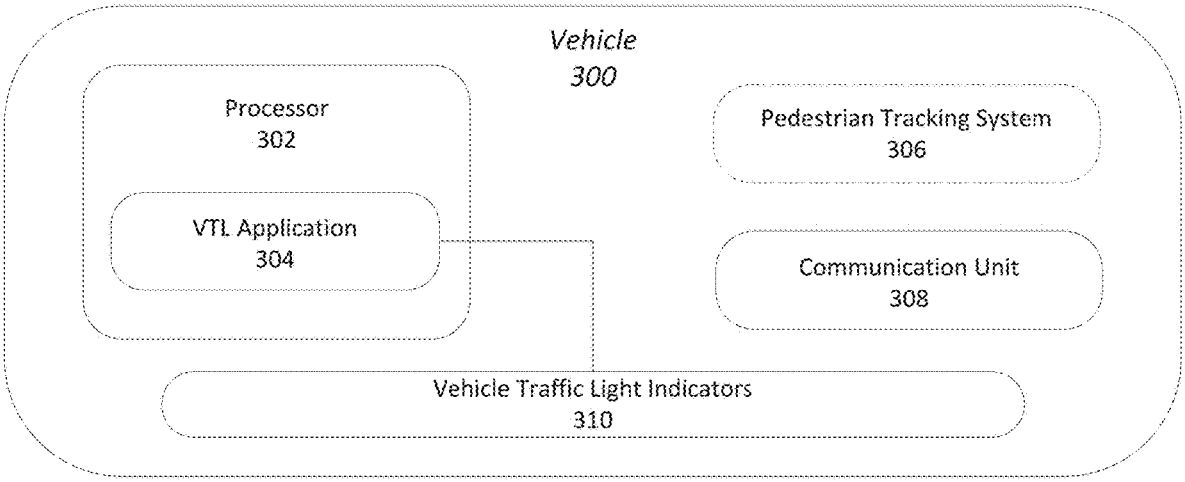
FIG. 3 is a block diagram of components of a VPTL system implemented on the vehicle end.

FIG. 3 is a block diagram showing one possible embodiment of the components of the system in vehicles 300 which are required to implement various embodiments of a VTL system modified to provide the VPTL functionality. Vehicles 300 may be equipped with a processor 302 running a VTL application 304 which has been modified to provide the additional functionality of the VPTL system. VTL application 304 controls a display comprising virtual traffic lights 310 for the vehicle 300. In addition, vehicle 300 may be equipped with a communication unit 308 which may be, for example, Wi-Fi, Bluetooth or any other well-known or later-developed wireless communication system providing short- or medium-range peer-to-peer wireless communication. In addition, vehicle 300 may be provided with pedestrian tracking system 306, which will be discussed later in conjunction with the pedestrian tracking system 206 of pedestrian device 200. In various embodiments, the processor 302 executing VTL application 304 may be integral to the vehicle 300 and may execute other software native to the vehicle 300. Virtual traffic light indicators 310 may be integrated into the driver instrumentation of the vehicle. Alternatively, VTL application 304 may be executed on a mobile computing device within the vehicle to provide the VTL functionality. For example, VTL application 304 could be run on mobile computing device, such as an iPhone® or iPad® device and may utilize a display integral with the vehicle 300 via the Apple CarPlay® facility to display virtual traffic light indicators 310. Alternatively, VTL application 304 may use the native display of the mobile computing device on which VTL application 304 is executing to display the virtual traffic light indicators 310.

Figure 4:
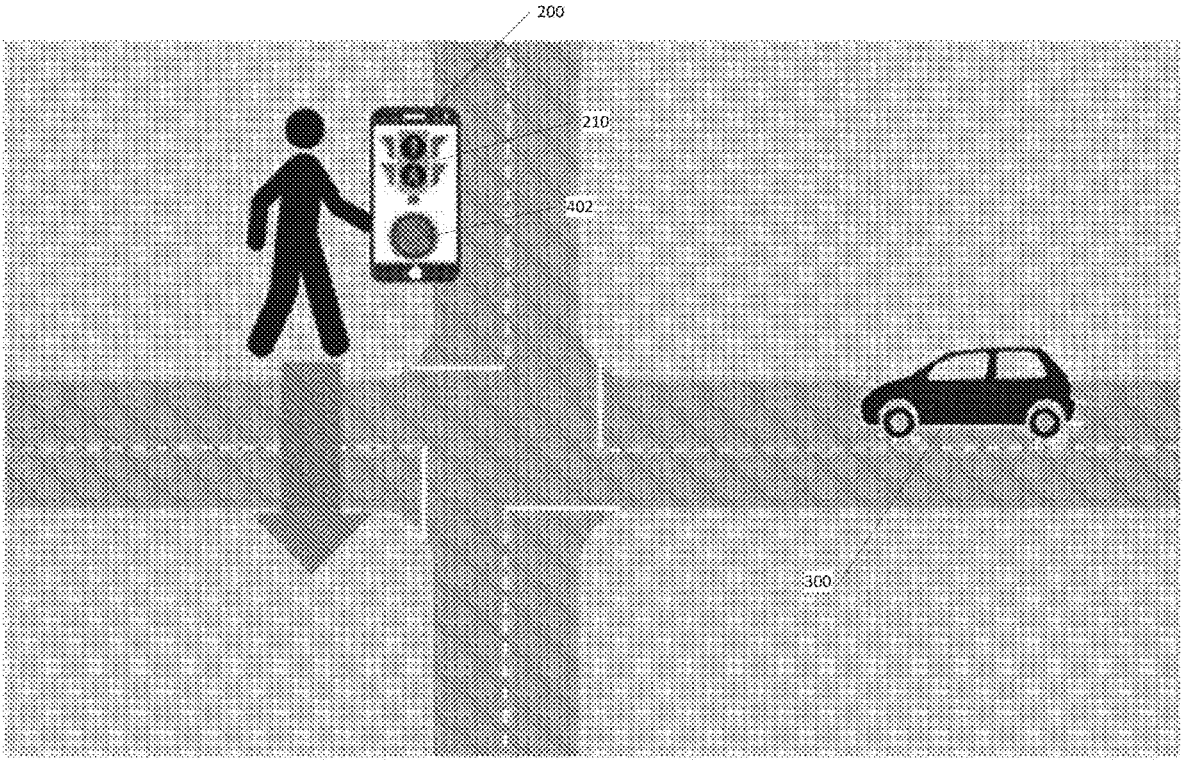
FIG. 4 is an illustration of a scenario showing a situation in which a pedestrian may use the VPTL system described herein.

FIG. 4 illustrates a simple scenario exemplary of various scenarios addressed by embodiments of the invention. There are two objects of interests in FIG. 4, pedestrian (i.e., pedestrian mobile computing device) 200 and vehicle 300. Pedestrian 200 wishes to cross the intersection in the direction of the arrow.

Software required to implement to the VPTL system is required on both the vehicle end and on the pedestrian end to implement the described virtual traffic light logic. The algorithm of the VPTL system can be integrated into existing VTL algorithms, such as those discussed in the Background section of this document or may be implemented independently.

Figure 5:
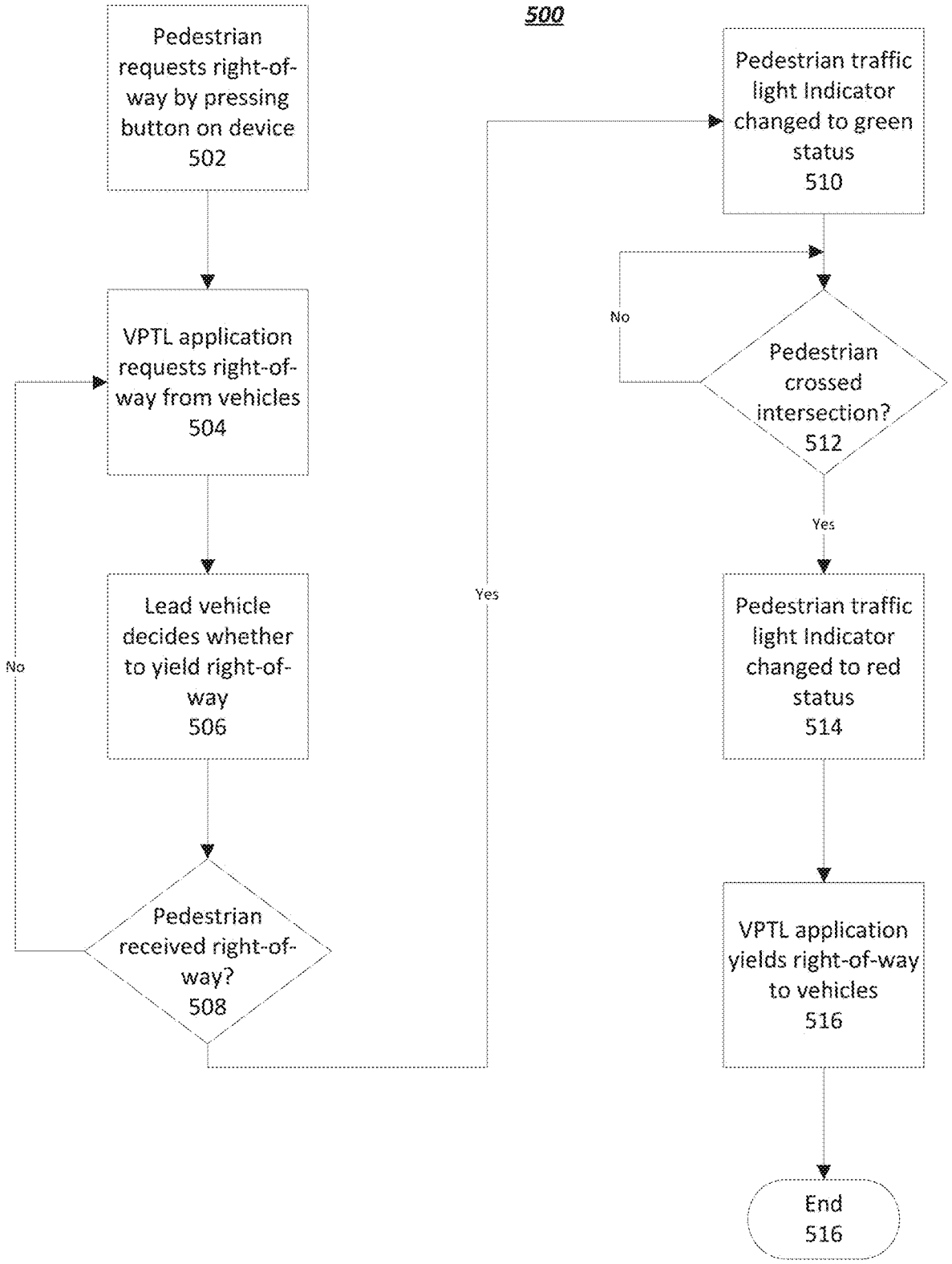
FIG. 5 is a flowchart showing the method of the present invention implemented in a VPTL application running on a personal mobile computing device of a pedestrian, which allows the pedestrian to request right-of-way to cross the intersection and to receive a visual indication that the right-of-way has been granted.

FIG. 5 illustrates the flow of process 500 of VPTL application 204 to allow the user to request the right-of-way to cross the intersection as shown in the exemplary scenario of FIG. 4. At 502, the pedestrian requests the right-of-way for crossing the intersection by pressing a button 402 displayed in the user interface of VPTL application 204 on the display of mobile computing device 200. As a result of a user selection of the button 402, at 504, the VPTL application 204 communicates wirelessly, via communication unit 208, with one or more vehicles 300 in the vicinity of the intersection via any well-known or later developed wireless communication protocol. In some embodiments, VPTL application 204 may send a broadcast message which may be received by all vehicles in the vicinity of the intersection or which may be targeted for a specific vehicle. In addition to an indication that the pedestrian is requesting the right-of-way, the broadcast message may include, for example, the location of the user as determined using a GPS receiver located on or integral to pedestrian mobile computing device 200 to indicate which intersection the pedestrian is requesting to cross. Vehicles 300 receiving the broadcast message may determine that they are approaching an intersection coincident with the location of the pedestrian, indicating that provision of the right-of-way at the intersection should take into account the presence of the pedestrian.

At 506, a lead vehicle amongst the one or more vehicles 300 approaching the intersection decides whether to yield the right-of-way to the pedestrian in accordance with VTL application 304 (as modified to include the VPTL functionality). This process is further described with respect to FIG. 6 below. At 508, if the pedestrian has not received the right-of-way, control returns to 504, where the VPTL application 204 makes an additional request for the right-of-way. At 508, if the pedestrian has received the right-of-way, control passes to box 510, where virtual pedestrian traffic light indicator 210 displayed by VPTL application 504 is changed from displaying a "red" status to displaying a "green" status, indicating that the pedestrian is free to safely cross the intersection. At 512, the pedestrian may be tracked until he or she has reached the opposite side of the intersection. Various methods of determining if the pedestrian has reached the opposite side of the intersection are explained below. If it is determined, at 512, that the pedestrian has crossed the intersection, at 514, the virtual pedestrian traffic light indicator is changed from displaying a "green" status to displaying a "red" status, indicating that the pedestrian phase of the traffic cycle is complete. At 516, the VPTL application 204 yields the right-of-way to vehicles and the VPTL process ends at 516.

The principle of operation of existing VTL systems may be generalized as follows: (1) Sensing: Vehicles approaching the intersection detect other vehicles via vehicle-to-vehicle (V2V) communications; (2) Lead Vehicle Selection: If a conflict is detected, the approaching vehicles select a lead vehicle in accordance with an algorithm of the VTL system. The selected lead vehicle temporarily controls the intersection and determines which vehicles have the right-of-way; (3) Broadcast: The lead vehicle broadcasts traffic light status information to the other vehicles, indicating which vehicles have the right-of-way (indicated by the display of a "green" status indication in those vehicles) and which vehicles must yield the right-of-way (indicated by the display of a "red" status indication in those vehicles). In one embodiment, the lead vehicle will always yield the right-of-way; (4) Handover: After the lead vehicle is selected, it decides how long each road crossing the intersection should receive the right-of-way; and (5) Release: When the lead vehicle no longer detects any conflicting vehicles, it will give the right-of-way to its own lane and release the lead vehicle functionality at the intersection. Now, the intersection has no lead vehicle, and whenever there is a new conflict, the approaching vehicles will select a new lead vehicle, starting from step (1).

To adopt the VTL process 600 to incorporate the functionality of the VPTL system, the VTL process 600 may be modified as follows: (1) In the Lead Vehicle Selection step, the detected conflicts will not only include conflicts between vehicles but also conflicts between vehicles and pedestrians; (2) In the Handover step, if VPTL is needed, instead of handing over to another VTL lead vehicle, the current VTL lead vehicle will hand over leadership to a VPTL lead vehicle and the VPTL lead vehicle will handle the pedestrian phase of the traffic cycle; (3) The VPTL lead vehicle will track pedestrians crossing the intersection and, when all pedestrians have crossed the intersection the VPTL lead vehicle will handover leadership to the next VTL lead vehicle according to the VTL Handover step. Thereafter, the VTL system will return to its normal operation. If not all of the pedestrians can be tracked, the VPTL lead vehicle will default to keeping the pedestrian phase of the traffic cycle enabled for a fixed time period.

Figure 6:
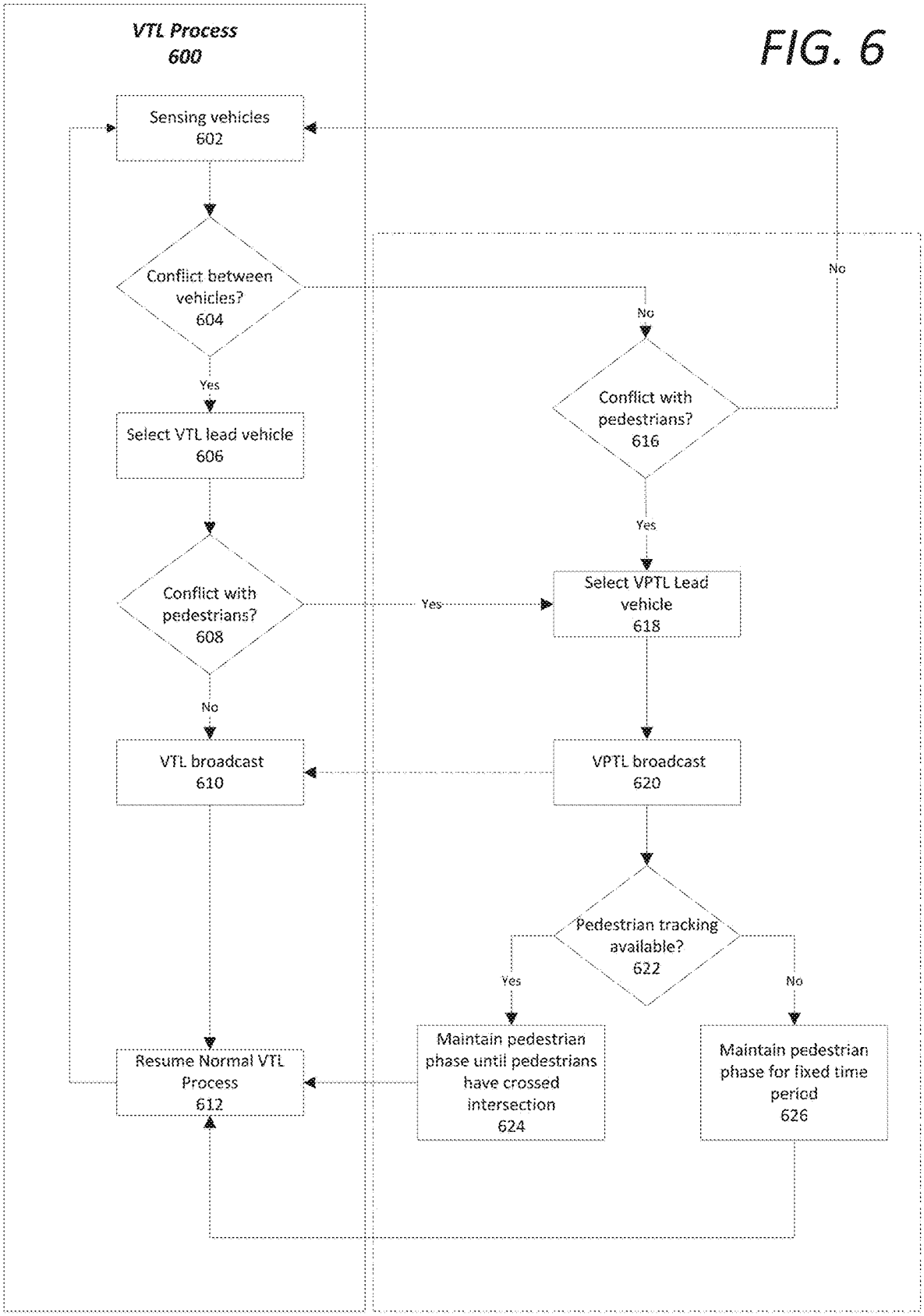
FIG. 6 is a flowchart showing the method of the present invention implemented in a VTL application running in a vehicle which has been modified to accommodate requests from pedestrians for the right-of-way at the intersection.

FIG. 6 shows the unmodified VTL process 600 executed in the one or more vehicles 300 and the modifications to the VTL process 600 (shown in the dotted line box) required to take into account the possible presence of pedestrians at the intersection. It should be realized that the VTL process is explained in terms of its execution in a single vehicle but that, ideally, all vehicles will be running their own instances of the VTL application. Further, it should be realized that, after a VTL lead vehicle is selected, much of the work of the VTL process is handled by the lead vehicle, with the other vehicles at or approaching the intersection only receiving status from the lead vehicle. As such, at some point during the explanation of the VTL process, the functionality changes from functions performed by all vehicles to functions performed only by the lead vehicle. Lastly, it should be noted that it is possible that when a vehicle approaches the intersection, a lead vehicle will have already been selected. As such, the newly-approaching vehicle is informed of the status of the intersection by the lead vehicle and takes no part in the selection of the lead vehicle.

With reference to FIG. 6, at 602, vehicle 300 senses for other vehicles. The sensing may be accomplished, for example, by each of the vehicles wirelessly broadcasting a periodic status, and wherein each vehicle listens for the broadcast status messages of other vehicles and determines, based on the status messages, that the vehicles are approaching the same intersection. The broadcast status messages may comprise, for example, the location and speed of the vehicle form which the message is broadcast. Thus, all vehicles approaching the intersection are aware of the location and speed of other vehicles approaching the intersection.

At 604, it is determined if there is a conflict between vehicle 300 and other vehicles approaching the intersection (a conflict exists if vehicles are approaching the intersection on intersecting roads and may not exist if vehicles are approaching the intersection on the same road). If no conflict exists between vehicle 300 and other vehicles approaching the intersection, at 616, it is determined if there is a conflict between vehicle 300 and a pedestrian at the intersection. This conflict will be indicated by the reception of a right-of-way request message (see step 504 in FIG. 5) from a VPTL application 204 running on a mobile computing device 200 located at the intersection (as indicated by the location information in the VPTL request). If it is determined at 616 that no conflict with pedestrians exists, control is returned to 602, where the vehicle 300 continues sensing for other vehicles. In this situation, vehicle 300 senses no conflict between vehicles or pedestrians, and is therefore free to proceed through the intersection. As such, the vehicle traffic light indicator 310 in vehicle 300 should display a "green" status.

If, at 616, a conflict with pedestrians is detected, control passes to 618, wherein a VPTL lead vehicle is selected. The VPTL lead vehicle may be selected, for example, as the vehicle closest to the intersection to enable tracking of the pedestrians as they cross the intersection. Other criteria may be used or considered to select the VPTL lead vehicle. Once the VPTL lead vehicle has been selected, the VPTL lead vehicle determines if the right-of-way should be yielded to the pedestrians. As an example, the right-of-way may not be yielded to the pedestrians if there are vehicles too close to the intersection to allow those vehicles to come to a safe and graceful stop at the intersection, given their current locations and speeds. If the right-of-way is to be yielded to the pedestrians, the VPTL lead vehicle broadcasts a status message at 620. The VPTL status message broadcast by the VPTL lead vehicle indicates that all vehicles approaching the intersection should yield the right-of-way and, as such, the virtual traffic light indicator 310 in each vehicle will display a "red" status. In addition, the VPTL application 210 receives an indication that it has received the right-of-way and, as such, the virtual pedestrian traffic light indicator 210 displayed by VPTL application 204 on pedestrian device 200 will display a "green" status, indicating that the pedestrian may safely cross the intersection. Note that, if it is decided that the right-of-way should not be yielded to the pedestrian, VTL broadcast 610 may be made in lieu of VPTL broadcast 620. VTL broadcast 610 will indicate that vehicles on one road approaching the intersection have the right-of-way while all other roads approaching the intersection, as well as the pedestrian, have yielded the right-of-way.

At 622, it is determined if it is possible to track pedestrians as they cross the intersection. The actual methods of tracking will be discussed below. If it is not possible to track the pedestrians, at 626, the pedestrian phase of the traffic cycle must default to being a fixed-time phase. However, if it is possible to track the pedestrians, at 624, the pedestrian phase of the traffic cycle is maintained until it is determined that all pedestrians have crossed the intersection. In either case, control thereafter proceeds to 614, where the normal VTL process resumes.

At 604, if is determined that there is a conflict between vehicles, a VTL lead vehicle will be selected at 606. The method for selecting the VTL lead vehicle is not germane to this discussion but is discussed in the publications mentioned in the Background section of this document. At 612, it is determined if there is a conflict with pedestrians, which may be determined as described above. If there is a conflict with pedestrians, control returns to box 618 where a VPTL lead vehicle is selected as described and the process proceeds as described above. Note that, in many cases, the VPTL lead vehicle and the VTL lead vehicle may be the same vehicle.

If, at 612, no conflict with pedestrians is detected, the VTL lead vehicle, at 610, will make a VTL broadcast. The VTL broadcast will indicate that vehicles traveling on one road approaching the intersection have been given the right-of-way, in which case the virtual traffic light indicator 310 in those vehicles will display a "green" status, while vehicles on all other roads approaching the intersection are yielding the right-of-way, in which case the virtual traffic light indicator 310 in those vehicles will display a "red" status. Eventually, after vehicle 300 has passed the intersection, the process will proceed to 602, were vehicle 300 resumes sensing for other vehicles at other intersections.

Various methods of tracking the pedestrian as the pedestrian crosses the intersection will now be discussed. In one embodiment of the invention, the pedestrian tracking system is implemented via direct communication between the vehicle and the pedestrian. In one example of this embodiment, the direct communication between the vehicle and the pedestrian may be provided via an ultra-wideband (UWB) system wherein vehicle 300 is provided with one or more tracking anchors and wherein the pedestrian 200 is provided with a tracking tag that may be tracked by tracking system 220 via direct communication between tracking tag 224 and tracking anchors 222.

A UWB module is able to provide precise localization using a time difference of arrival (TDOA) concept and is able to achieve concurrent data transfer with high multi-path fading immunity. The distance measurement is based on differences in the time of flight between data packets received from two or more UWB anchors located on or within vehicle 300 in response to a data packet sent to the anchors 222 by the UWB tag 224 located with the pedestrian 200.

Figure 7:
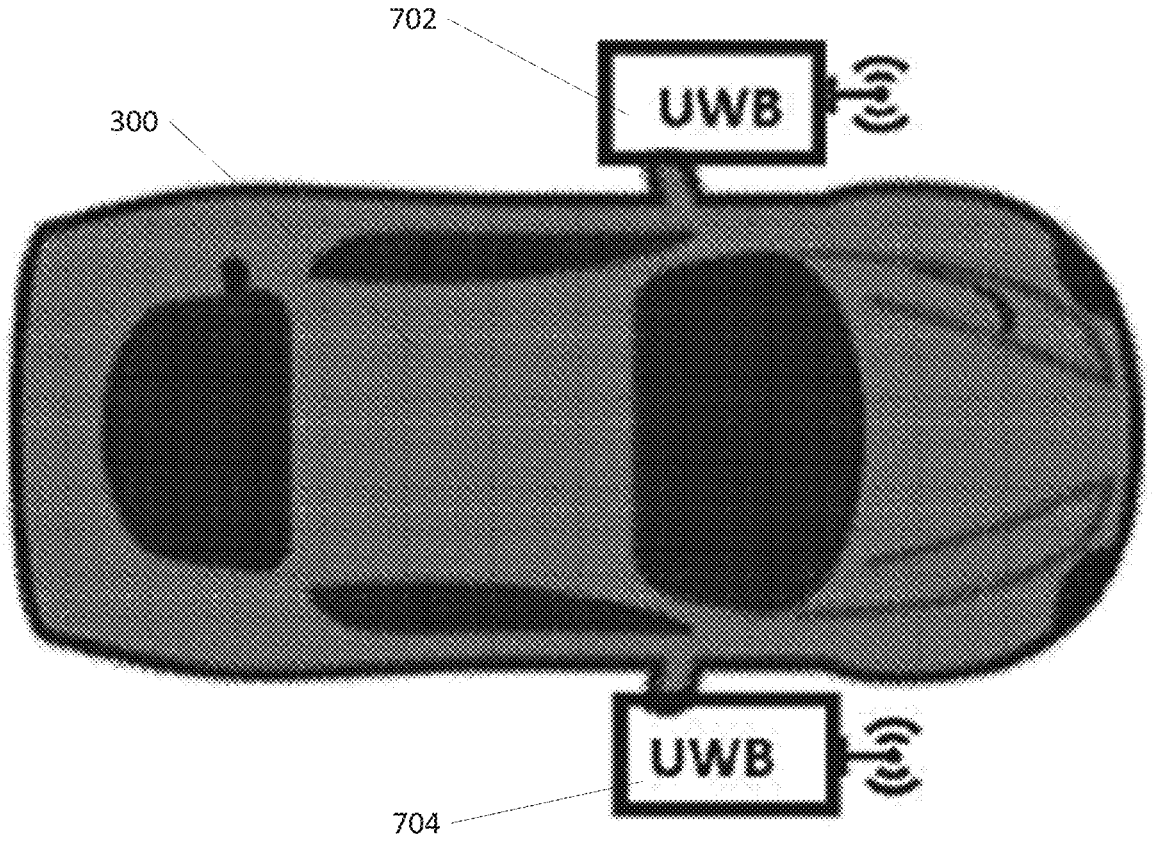
FIG. 7 is a graphical representation of a vehicle showing optimal placement of a pair of UWB anchors.

FIG. 7 shows the one possible configuration for an on-vehicle UWB anchor layout appropriate for localizing pedestrians as they cross and intersection. The two UWB anchors, 702, 704, are installed on the rear-view mirrors of vehicle 300. These locations were chosen as providing the largest distance between the two anchors on the vehicle, and hence minimizes any localization error. Because the locations (i.e., the coordinates) of the anchors are known, by measuring the distance between the anchors and the tag, triangulation techniques can be used to calculate the position coordinates of the tag. In alternate embodiments, the anchors could be permanently located at the intersection. Thus, in this embodiment, pedestrian 200 determines when he or she has reached the opposite end of the intersection and informs VPTL lead vehicle via a wireless status message.

In other embodiments, the pedestrian tracking system may be based on GPS. The pedestrian tracking system, in this embodiment, is fully implemented on the pedestrian side. In this embodiment VPTL application 204 determines the exact location of the pedestrian 200 via a GPS-based tracking system 206 and informs vehicle 300 when the pedestrian 200 has reached the opposite side of the intersection, in a manner similar to that used with the UWB-based system.

In embodiments wherein the pedestrian is capable of self-tracking, any known means of communication with the VPTL lead vehicle 300 may be used to inform VPTL lead vehicle 300 that the pedestrian has reached the opposite side of the intersection, for example, near-field communication (NFC), radio-frequency identification (RFID), Bluetooth low energy, Wi-Fi and any other means of wireless communication now known or later developed may be used.

In yet other embodiments, the VPTL lead vehicle 300 may unilaterally determine whether the intersection is clear by imaging the intersection with an onboard camera or by scanning the intersection with RADAR or LIDAR. By unilaterally determining if the intersection is clear of pedestrians, the need for communication between VPTL lead vehicle 300 and VPTL application 204 is eliminated.

It should also be noted that the tracking functions and the communication between pedestrians and vehicles, in come embodiments, may be based on the same technology. For example, in some embodiments, UWB technology can be used both for tracking the pedestrian and for communication between the VPTL application 204 running on the pedestrian mobile computing device 200 and the VTL software 304 running in VPTL lead vehicle 300.

Upon being given the right-of-way, VPTL application 204 may broadcast a message to inform the VPTL lead vehicle 300 that is capable of self-tracking and, therefore, capable of determining when the pedestrian has reached the opposite side of the intersection. As such, the VPTL lead vehicle 300 knows to wait for the signal indicating that pedestrian 200 has reached the opposite side of the intersection, thereby indicating that the right-of-way should be yielded by pedestrian 200 and given to vehicles on one of the roads passing through the intersection. Absent a message informing the VPTL lead vehicle 300 that pedestrian 200 is capable of self-tracking (and absent a vehicle capable of unilaterally tracking the pedestrian), the VPTL lead vehicle 300 must allow the pedestrian phase to become a timed phase lasting for a pre-determined period of time. Once VPTL application 204 determines that pedestrian 200 has reached the opposite side of the intersection, another message is sent to the VPTL lead vehicle 300 to inform the VPTL lead vehicle 300 that the intersection is now clear, thus allowing the VPTL lead vehicle 300 relinquish the lead vehicle role to a VTL lead vehicle, which is then responsible for assigning the right-of-way to vehicles on one road passing through the intersection. Once pedestrian 200 has yielded the right-of-way, the virtual pedestrian traffic light indicator 210 will display a "red" status.

It should be noted that embodiments of the invention described above were described in the context of a single pedestrian requesting the right-of-way to cross an intersection. However, as would be realized of one of skill in the art, the invention is equally applicable to instances where multiple, sometimes many, pedestrians wish to cross the intersection. In such cases, the progress of each individual pedestrian must be tracked as he or she crosses the intersection and the VPTL lead vehicle at the intersection must wait until indications have been received that all pedestrians who had requested the right-of-way to cross intersection have indeed crossed the intersection before the pedestrian phase may be ended.

The invention has been described in terms of specific implementations based on the use of specific methods and components. As would be realized by one of skill in the art, variations of the described systems and methods resulting in the desired outcome are possible and are considered to be within the scope of the invention, which is defined by the following claims.

The invention claimed is:

1. A method executed by a lead vehicle at or approaching a traffic intersection comprising:

receiving, from a mobile device carried by a pedestrian at the intersection, a broadcast message indicating a request for right-of-way to cross the intersection;

broadcasting, to other vehicles at or approaching the intersection, a signal indicating that the other vehicles should yield the right-of-way;

sending a signal to the pedestrian from whom the request was received granting the right-of-way; and sending a signal granting the right-of-way to one or more vehicles after the pedestrian has crossed the intersection.

2. The method of claim 1 further comprising:

tracking the pedestrian as the pedestrian crosses the intersection.

3. The method of claim 2 wherein the lead vehicle is selected by one or more vehicles at or approaching the intersection to control the right of way at the intersection.

4. The method of claim 2 further comprising:

displaying a red indication on a display in the lead vehicle.

5. The method of claim 2 further comprising:

sending a signal to the pedestrian from whom the request was received indicating that the pedestrian's right-of-way has been yielded.

6. The method of claim 2 wherein multiple pedestrians are crossing the intersection and further wherein the step of tracking the pedestrians includes tracking all pedestrians having a mobile computing device in communication with the lead vehicle who are crossing the intersection.

7. The method of claim 6 wherein the step of sending a signal to the pedestrian from whom the request was received granting the right-of-way is sent to all pedestrians having a mobile computing device in communication with the lead vehicle who are crossing the intersection.

8. The method of claim 2 wherein the pedestrian is tracked using a GPS component of the mobile computing device.

9. The method of claim 8 wherein the location of the mobile computing device as it crosses the intersection is tracked using a UWB-based system, further comprising:

calculating a location of the mobile computing device by comparing a time of flight for a communication between a UWB tag and two or more UWB anchors.

10. The method of claim 2 wherein the received request includes a location of the mobile computing device.

11. A system in by a lead vehicle at or approaching a traffic intersection comprising:

a processor;

a display; and software that, when executed by the processor, causes the system to:

receive, from a mobile device carried by a pedestrian at the intersection, a broadcast message indicating a request for right-of-way to cross the intersection;

broadcast, to other vehicles at or approaching the intersection, a signal indicating that the other vehicles should yield the right-of-way;

send a signal to the pedestrian from whom the request was received granting the right-of-way; and send a signal granting the right-of-way to one or more vehicles after the pedestrian has crossed the intersection.

12. The system of claim 11, the software further causing the system to:

track the pedestrian as the pedestrian crosses the intersection.

13. The system of claim 12 wherein the lead vehicle is selected by one or more vehicles at or approaching the intersection to control the right of way at the intersection.

14. The system of claim 12 the software further causing the system to:

display a red indication on the display.

15. The system of claim 12, the software further causing the system to:

send a signal to the pedestrian from whom the request was received indicating that the pedestrian's right-of-way has been yielded.

16. The system of claim 12 wherein multiple pedestrians are crossing the intersection and further wherein the step of tracking the pedestrian includes tracking all pedestrians having a mobile computing device in communication with the lead vehicle who are crossing the intersection.

17. The system of claim 16 wherein the step of sending a signal to the pedestrian from whom the request was received granting the right-of-way is sent to all pedestrians having a mobile computing device in communication with the lead vehicle who are crossing the intersection.

18. The system of claim 12 wherein the pedestrian is tracked using a GPS component of the mobile computing device.

19. The system of claim 18 wherein the location of the mobile computing device as it crosses the intersection is tracked using a UWB-based system, the software further causing the system to:

calculate a location of the mobile computing device by comparing a time of flight for a communication between a UWB tag and two or more UWB anchors.

20. The system of claim 12 wherein the received request includes a location of the mobile computing device.

* * * * *